US005240098A

United States Patent [19]

Desai et al.

[11] Patent Number: 5,240,098

[45] Date of Patent: Aug. 31, 1993

[54] COIN OPERATED PERSONAL COMPUTER WITH KEYBOARD DISABLE

[76] Inventors: Ashok N. Desai, 10306 Briar River, Houston, Tex. 77042; Mrugesh D. Thaker, Houston, Tex. 77089

[21] Appl. No.: 760,083

[22] Filed: Sep. 16, 1991

[51] Int. Cl.[5] ..... G07F 17/00

[52] U.S. Cl. ..... 194/219; 194/241; 340/825.55

[58] Field of Search ..... 194/215, 216, 217, 218, 194/219, 241, 242; 340/825.55

[56] References Cited

U.S. PATENT DOCUMENTS

| | | | |
|---|---|---|---|
| 3,938,093 | 2/1976 | Riess | 340/825.55 |
| 4,370,649 | 1/1983 | Fuerle | 235/381 X |
| 4,566,033 | 1/1986 | Reidenouer | 194/241 X |
| 4,821,862 | 4/1989 | Nelson | 194/241 |
| 4,926,997 | 5/1990 | Parker | 194/241 X |

*Primary Examiner*—F. J. Bartuska

*Attorney, Agent, or Firm*—Kenneth A. Roddy

[57] ABSTRACT

A coin-operated personal computer is controlled by a coin box having a timing mechanism to allow a user to operate the computer for a predetermined amount of time for a fee. The computer keyboard which is used to enter and/or retrieve information is connected through the coin operated timing mechanism such that the driving mechanism of the personal computer, data storage, memory, etc., is operational at all times, but the keyboard data transmission line which is used to enter and/or retrieve information is disabled at the end of the time period. The file or data which the user is working on is not lost when the timer disables the keyboard, since the other components of the computer system remain on and operational to retain the data, and in the event that the user has not completed the work at the end of the time period, another coin can be inserted for additional time in which the work can be completed or saved to memory storage.

4 Claims, 2 Drawing Sheets

COIN OPERATED PERSONAL COMPUTER WITH KEYBOARD DISABLE

BACKGROUND OF THE INVENTION

1. Field of the Invention

This invention relates generally to coin-operated devices, and more particularly to a coin operated personal computer controlled by a coin box having a timer which controls the operability of the computer keyboard for a predetermined period of time independently of the other computer components which remain operational at all times.

2. Brief Description of the Prior Art

The personal computer is revolutionizing nearly all fields known to mankind, The personal computer, for the most part, is confined within offices, schools, and behind counters. Although computer time sharing and computer labs are available, the hours of availability and cost place constraints on the user. Their usage is limited to those individuals who can afford them.

It would therefore be desirable to provide personal computers for use, at any time of day or night, by the general public at public places such as libraries, hotels, shopping centers, airports, schools, etc., for a nominal fee.

Coin-operated video games are known which do not utilize a keyboard and operate with an "EPROM" or permanently programmed memory chip. Video games are only capable of providing entertainment and do not provide the features of a personal computer which offers the user unlimited utility.

There are several patents which disclose various coin-operated devices.

Reidenouer, U.S. Pat. No. 4,566,033 discloses a television viewing time regulator having a solid state timer activated by a reed switch installed between a television receiver and an electrical wall outlet. The regulator has a passageway adjacent the reed switch for the reception of magnetic tokens which act on the reed switch, in turn activating the timer and completing a circuit through the television receiver. The power to the television receiver is automatically turned off after a predetermined time period.

Nelson, U.S. Pat. No. 4,821,862 discloses a coin-operated timer for pay television which has a coin box interposed in the path of a signal input line that supplies program signals to the television receiver. One or more frequency band filters (frequency traps) within the coin box normally prevent reception of some of the channels, and a bypass circuit controlled by a relay bypasses the frequency band filters during time periods that have been paid for.

Parker, U.S. Pat. No. 4,926,997 discloses a coin operated device and method for car washes which requires a threshold number of coins to activate its operation. Once operation is stopped, a time window is provided during which the deposit of fewer than the threshold number of coins may restart the device.

The present invention is distinguished over the prior art in general, and these patents in particular by a coin-operated personal computer controlled by a coin box having a timing mechanism to allow a user to operate the computer for a predetermined amount of time for a fee. The computer keyboard which is used to enter and/or retrieve information is connected through the coin operated timing mechanism such that the driving mechanism of the personal computer, data storage, memory, etc., is operational at all times, but the keyboard data transmission line which is used to enter and/or retrieve information is disabled at the end of the time period. The file or data which the user is working on is not lost when the timer disables the keyboard, since the other components of the computer system remain on and operational to retain the data, and in the event that the user has not completed the work at the end of the time period, another coin can be inserted for additional time in which the work can be completed or saved to memory storage.

SUMMARY OF THE INVENTION

It is therefore an object of the present invention to provide a coin operated personal computer which will allow a user to operate the computer for a period of time upon payment of a fee.

It is another object of this invention to provide a coin operated personal computer wherein only the keyboard is controlled by a coin box such that the driving mechanism of the personal computer, data storage, memory, etc., is operational at all times, but the keyboard data transmission line which is used to enter and/or retrieve information is disabled at the end of the time period.

Another object of this invention to provide a coin operated personal computer having a keyboard controlled by a coin box which will prevent loss of files or data being worked on at the end of a timed period and will retain the data in the event that the user has not completed the work at the end of the time period so that another coin can be inserted for additional time in which the work can be completed or saved to memory storage.

Another object of this invention is to provide a coin operated personal computer system which is self operating and does not require an attendant to offer the service.

A further object of this invention is to provide a coin operated personal computer system which is easily installed in public places to offer a valuable computer time service at any hour of the day or night.

A still further object of this invention is to provide a coin operated personal computer system which is simple in design and construction, reliable in use, and economical to manufacture.

Other objects of the invention will become apparent from time to time throughout the specification and claims as hereinafter related.

The above noted objects and other objects of the invention are accomplished by the present coin-operated personal computer which is controlled by a coin box having a timing mechanism to allow a user to operate the computer for a predetermined amount of time for a fee. The computer keyboard which is used to enter and/or retrieve information is connected through the coin operated timing mechanism such that the driving mechanism of the personal computer, data storage, memory, etc., is operational at all times, but the keyboard data transmission line which is used to enter and/or retrieve information is disabled at the end of the time period. The file or data which the user is working on is not lost when the timer disables the keyboard, since the other components of the computer system remain on and operational to retain the data, and in the event that the user has not completed the work at the end of the time period, another coin can be inserted for additional time in which the work can be completed or saved to memory storage.

DESCRIPTION OF THE PREFERRED EMBODIMENT

Figure 1:
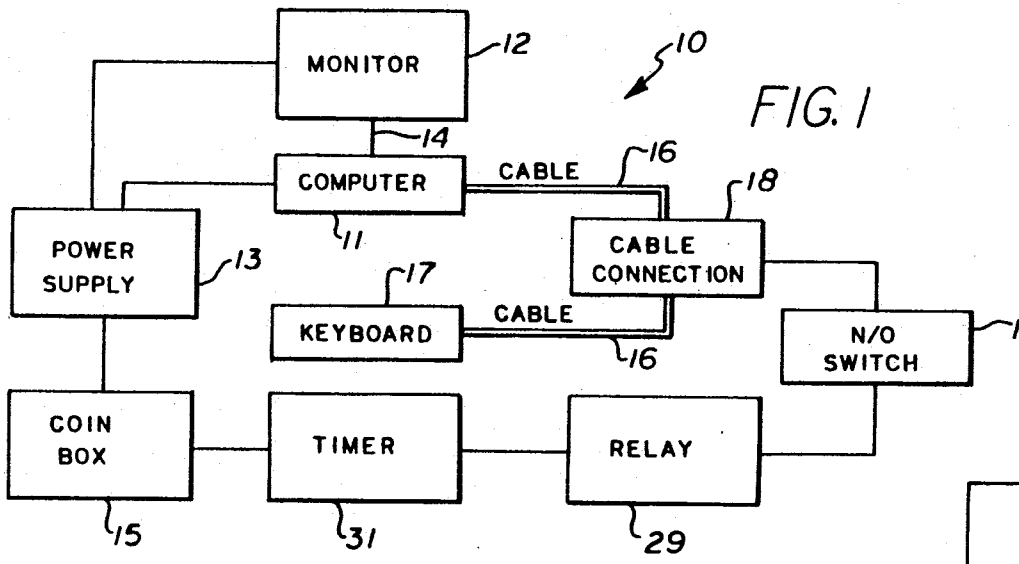
FIG. 1 is a schematic block diagram of the coin-operated personal computer system of apparatus in accordance with the present invention.
Figure 2:
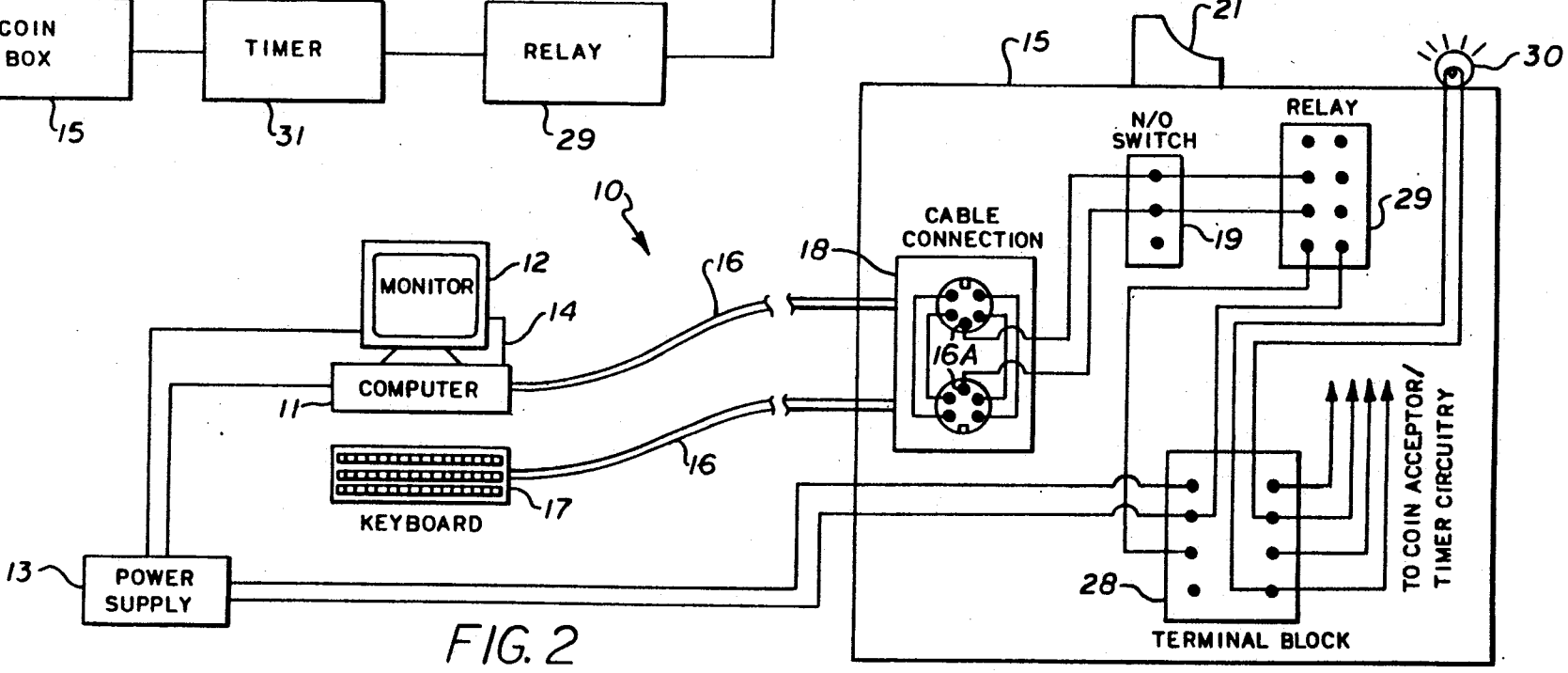
FIG. 2 is a schematic block diagram, partially in block form, showing the connection of the keyboard cable with the coin box.

Referring to the drawings by numerals of reference, there is shown in block diagram form in FIG. 1, and in schematic form in FIG. 2, a preferred coin-operated personal computer system 10. The personal computer has at least one diskette drive for receiving a data diskette of a user, first memory storage means for storing data, second memory means having stored data processing programs for processing and manipulating data, a video display controller, input and output ports for receiving and transmitting data, and a central processing unit responsive to user input for controlling the operation of the memories, the input and output ports, and the video display controller.

The personal computer 11 and a video display screen or monitor 12 are both connected to a source of electrical power 13. The monitor 12 is connected to the computer 11 by the usual cable 14 and is controlled by the video display controller. A keyboard 17 is connected by a cable 16 to the computer and has user input keys for inputting and retreiving data and controlling the operation of the computer.

A coin operated accumulator/timer or coin box 15 is also connected to the electrical power source 13. The cable 16 which leads from the computer keyboard 17 used to enter and/or retrieve information is connected through a cable connection 18 in or on the housing of the coin box 15. It should be noted that in the present system, that the driving mechanism of the personal computer, data storage, memory, etc., is operational at all times, but the keyboard data transmission line which is used to enter and/or retrieve information is disabled at the end of a predetermined time period.

The keyboard cable 16 is made up of a plurality of wires which are dedicated to perform various duties and includes a data transmission wire 16A which is connected to a pin at each end of the end of the cable. At the cable connection 18 this data transmission wire 16A is intercepted and a normally open switch 19 is connected in series in the data transmission line to control the transmission of data signals through the wire 16A.

Figure 3:
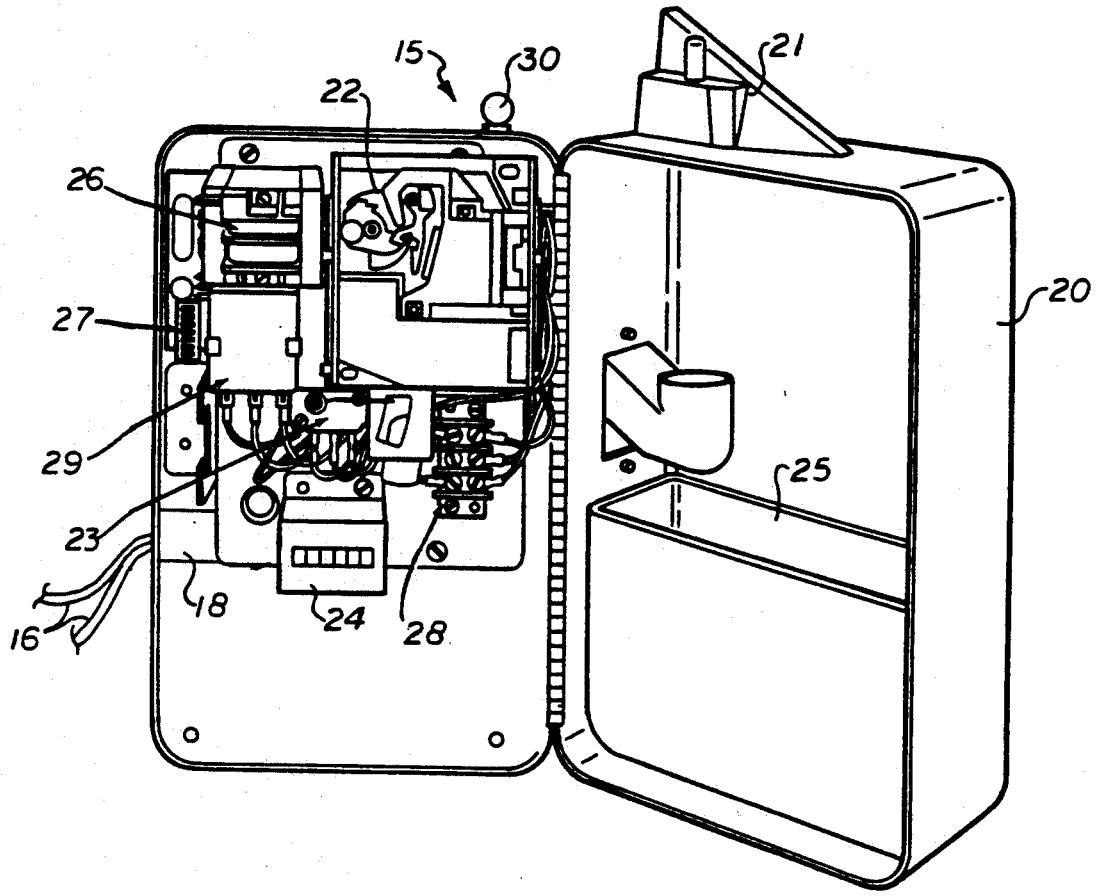
FIG. 3 is a perspective view of the interior of a coin box accumulator/timer showing the major components.

Referring now additionally to FIG. 3, the coin operated accumulator/timer or coin box 15 includes a lockable housing 20, coin input mechanism 21, coin acceptor mechanism 22, coin switch 23, coin meter or counter 24, coin storage box 25, a transformer 26, manual vend time setting switches 27, a terminal block 28, a vend relay 29, and an indicator light 30. Also shown in FIG. 3, is the cable connection 18 within the housing 20.

The manual vend time setting switches 27 allow the proprietor to select the type of coins and number required to produce an output from the coin accumulator/timer. The coin accumulator/timer 15 also includes a programmable electronic timer 31 (not seen in FIG. 3) of the type which will allow the proprietor to select the length of the timing cycle. The selection of the control parameters such as vend time and price may be adjusted at will by the proprietor of the establishment at which the device is located.

The preferred electronic timer is programmable for a length of time ranging from ¼ second to 30 hours, and the coin acceptor will accept nickles, dimes, quarters, or dollars. The electronic timer has a programmable binary time cycle base in increments of ¼ second, ½ second, 1 second, ¼ minute, ½ minute, and 1 minute. The electronic timer can also be programmed to accumulate time for any predetermined number of coins up to 15 coins. One full time cycle is exercised for each coin inserted before initiating a vend.

The terminal block 28 is connected to the power source 13 and provides a point of connection for the associated coin acceptor mechanism 22, timer circuitry, and indicator light 30. The timer 31 has an output connected to the vend relay 29. The output terminals of the vend relay 29 are connected to the switch 19 which is normally open to prevent transmission of data signals between the keyboard 17 and the computer 11.

When the timer 31 initiates its timing or counting cycle, the vend relay 29 is activated to close the normally open switch 19 completing the data transmission circuit between the keyboard 17 and the computer 11. When the timer 31 completes its timing or counting cycle, the vend relay 29 is activated to open the switch 19 to disable the data transmission circuit between the keyboard 17 and the computer 11. Even though the data transmission circuit is disabled, the driving mechanism of the personal computer, data storage, memory, etc., is operational at all times, only the keyboard is non-functional.

In the event that the user has not completed the work at the end of the time period, another coin can be inserted for additional time in which the work can be completed or saved to memory storage.

While this invention has been described fully and completely with special emphasis upon a preferred embodiment, it should be understood that within the scope of the appended claims the invention may be practiced otherwise than as specifically described herein.

I claim:

1. A personal computer system having timed control means comprising;

a personal computer including power input means for connection to a source of electrical power, at least one diskette drive for receiving a data diskette of a user, first memory storage means for storing data, second memory means having stored data processing programs for processing and manipulating data, a video display controller, input and output ports for receiving and transmitting data, and a central processing unit responsive to user input for controlling the operation of said memories, said input and output ports, and said video display controller, a video display screen operatively connected to said computer video display controller, a keyboard operatively connected to said computer central processing unit by a cable through which signals are transmitted and having user input keys for inputting and retrieving data and controlling the operation of said computer, a cable having a plurality of dedicated lines through which signals are transmitted between said keyboard and said computer central processing unit including a keyboard data signal transmission line for transmitting data signals, and an electrical coin operated accumulator/timer including cable connection means operatively connected with said cable and switch means connected with said keyboard data signal transmission line of said cable to control the transmission of data signals between said keyboard and said computer central processing unit to allow operation of said computer and two way communication therewith for a predetermined length of time for a fee and upon expiration of the length of time, to disable only said keyboard data signal transmission line of said cable to prevent transmission of the data signal and keyboard operation of said computer without loss of data, whereby only the keyboard data signal is interrupted and said keyboard is disabled upon expiration of the predetermined length of time while the other components of the computer system remain operational at all times to prevent loss of data, and upon payment of an additional fee, said switch means will reconnect said keyboard data signal line and enable keyboard operation for another predetermined length of time to allow data to be inputted, retrieved, and stored by the keyboard user.

2. A personal computer system according to claim 1 in which;

said accumulator/timer includes a timer and a vend relay, said timer having an output connected to said vend relay and said vend relay having output terminals connected to said switch means, whereby upon said timer initiating a timing or counting cycle, said vend relay is activated to close said switch means to complete the data transmission circuit through said keyboard data signal transmission line of said keyboard cable allowing data signals to be transmitted between said keyboard and said central processing unit and upon said timer completing the timing or counting cycle, said vend relay is activated by said timer to open said switch means to break the data transmission circuit through said keyboard data signal transmission line of said keyboard cable.

3. An electrical coin operated accumulator/timer for controlling the operation of a computer of the type having memory means for storing, processing, and manipulating data, a video display controller, a central processing unit responsive to user input for controlling the operation of said memory means, a video display screen operatively connected to the video display controller, and a keyboard operatively connected to the central processing unit by a cable and having keys for inputting and retrieving data and to control the operation of said computer, said cable having a plurality of dedicated lines through which signals are transmitted between said keyboard and said computer central processing unit including a keyboard data signal transmission line for transmitting data signals, the accumulator/timer comprising;

an electrical coin operated accumulator/timer operatively connected with said cable between said keyboard and said computer central processing unit to allow operation of said computer and two way communication therewith for a predetermined length of time for a fee and upon expiration of the length of time, to disable only said keyboard data signal transmission line of said cable to prevent transmission of the data signal and keyboard operation of said computer without loss of data;

a timer and a vend relay, said timer having an output connected to said vend relay and said vend relay having output terminals;

switch means operatively connected to said vend relay output terminals; and cable connection means operatively connected with said switch means and with said keyboard data signal transmission line of said cable;

said switch means connected with said keyboard data signal transmission line to selectively enable or disable transmission of data signals therethrough; and upon said timer initiating a timing or counting cycle, said vend relay is activated to close said switch means to complete the data transmission circuit through said keyboard data signal transmission line of said cable allowing data signals to be transmitted between said keyboard and said computer central processing unit and upon said timer completing the timing or counting cycle, said vend relay is activated by said timer to open said switch means to break the data transmission circuit through said keyboard data signal transmission line of said cable; whereby only the keyboard data signal is interrupted and said keyboard is disabled upon expiration of the predetermined length of time while the other components of the computer system remain operational at all times to prevent loss of data, and upon payment of an additional fee, said vend relay will activate said switch means to reconnect said keyboard data signal line and enable keyboard operation for another predetermined length of time to allow data to be inputted, retrieved, and stored by the keyboard user.

4. A computer keyboard disable circuit for controlling the transmission of data between a keyboard and a computer having a central processing unit through a keyboard cable connected between the keyboard and the computer which has a plurality of dedicated lines through which signals are transmitted between the keyboard and the computer central processing unit including a keyboard data signal transmission line for transmitting data signals, said keyboard disable circuit comprising;

a cable connector adapted to be interposed in the cable between the computer keyboard and the central processing unit of the computer, switch means operatively connected to said cable connector and to the keyboard data signal transmission line of said keyboard cable, and a relay operatively connected to said switch means to selectively move said switch means between an open position and a closed position, said switch means in the open position completing a data transmission circuit through said keyboard cable data signal transmission line to allow data signals to be transmitted between said keyboard and said computer central processing unit, and in the closed position breaking only the data transmission circuit through said keyboard cable data signal transmission line to prevent only the transmission of data signals through said keyboard cable while allowing transmission of other signals through said keyboard cable such that only keyboard operation is disabled and other components of the computer system remain operational at all times.

* * * * *